US006185771B1

(12) United States Patent
Trusty, Sr.

(10) Patent No.: US 6,185,771 B1
(45) Date of Patent: Feb. 13, 2001

(54) POCKET TOOL HAVING SLIDABLY EXTENSIBLE PLIERS

(76) Inventor: John E. Trusty, Sr., 8757 East Ave., Mentor, OH (US) 44060

( * ) Notice: Under 35 U.S.C. 154(b), the term of this patent shall be extended for 0 days.

(21) Appl. No.: 09/455,394

(22) Filed: Dec. 6, 1999

(51) Int. Cl.[7] ..... B25B 7/22
(52) U.S. Cl. ..... 7/128; 81/416; 30/162
(58) Field of Search ..... 7/127, 128; 81/300, 81/427.5, 416; 30/160, 161, 162

(56) References Cited

U.S. PATENT DOCUMENTS

| | | | | |
|---|---|---|---|---|
| 4,238,862 | * | 12/1980 | Leatherman | 7/128 |
| 4,502,220 | * | 3/1985 | Aoki | 30/154 |
| 5,062,173 | | 11/1991 | Collins . | |
| 5,142,721 | * | 9/1992 | Sessions et al. | 7/128 |
| 5,212,844 | | 5/1993 | Sessions et al. . | |
| 5,267,366 | | 12/1993 | Frazer . | |
| 5,491,856 | * | 2/1996 | Legg | 7/128 |
| 5,503,049 | * | 4/1996 | Chervenak et al. | 81/427.5 |
| 5,664,274 | * | 9/1997 | Collins | 7/129 |
| 5,697,114 | | 12/1997 | McIntosh et al. . | |
| 5,809,599 | | 9/1998 | Frazer . | |
| 5,809,600 | | 9/1998 | Cachot . | |
| 5,829,329 | | 11/1998 | Frazer . | |

* cited by examiner

*Primary Examiner*—James G. Smith
*Assistant Examiner*—David B Thomas
(74) *Attorney, Agent, or Firm*—Joseph H. Taddeo

(57) ABSTRACT

The present invention relates primarily to a versatile hand-held pocket tool having slidable pivoted jaws that are extensible from within the handle grips. The pivoted jaws are rotatably locked in the extended position thereby preventing the pliers from retracting when being used. When not in use the pliers are retracted into each of the handle grips and rotatably locked, maintaining the jaws in their storage position. Each of the jaws has two cutting surfaces; one notched cutting surface for cutting wire and one shearing surface for wire stripping and the like. Two foldable pivoted screwdrivers comprising a flattened blade type and a Phillips end type are included to provide versatile portable tool operation. The pocket tool can be manufactured using powdered metal technology to reduce the manufacturing cost and to ensure greater uniformity and precision.

23 Claims, 7 Drawing Sheets

POCKET TOOL HAVING SLIDABLY EXTENSIBLE PLIERS

FIELD OF THE INVENTION

The present invention relates primarily to a multifunctional hand-held pocket tool with extensible pliers and more particularly to a pocket tool having pivoted jaws that are slidably extensible from within the handle grips when in use and slidably retractable when not in use.

BACKGROUND OF THE INVENTION

Multiple function tools are well known in the prior art. Disclosed are several pocket tools having a multiplicity of working tools for portable hand-held use. Examples of such prior art are shown in the examples that follow.

U.S. Pat. No. 5,829,329, granted Nov. 3, 1998, to S. Frazer, discloses a hand tool having retractable jaws. The assembly of interconnected jaws is pivotally mounted itself on one or more handles that define a housing for the jaw assembly.

U.S. Pat. No. 5,809,600, granted Sep. 22, 1998, to M. Cachot, discloses a multifunctional pocket tool capable of receiving removable screwing attachments, such as Phillips attachments, flat screwdrivers, socket wrenches, socket keys and a corkscrew.

U.S. Pat. No. 5,809,599, granted Sep. 22, 1998, to S. Frazer, discloses a compound pliers tool having linked handles. Each handle is channel shaped having recesses into which, the pivoted interconnecting jaw members can be swung so that they are nested into the handles or alternatively, retracted so as to be partially contained within the handles.

U.S. Pat. No. 5,697,114, granted Dec. 16, 1997, to H. J. McIntosh, et al., discloses a folding multi-tool having channel shaped handles, the partly closed sides comprising plier-receiving openings. The folding multi-tool is foldable between a closed compact configuration, and an open extended configuration for operating the pliers.

U.S. Pat. No. 5,491,856, granted Feb. 20, 1996, to L. K. Legg, teaches of a foldable pair of pliers, a flat screwdriver, a Phillips screwdriver, a wire cutting notch and a scissors shear, with each handle being pivotally displaceable between a foldable position and an extendible position.

U.S. Pat. No. 5,267,366, granted Dec. 7, 1993, to S. Frazer, discloses a combination hand tool with retractable pliers jaws. The movement of the jaw members from the projected position automatically swings the handles together. Mechanism is provided to interconnect the handles when the jaw members are retracted.

U.S. Pat. No. 5,212,844, granted May 28, 1993, to G. C. Sessions, et al., teaches of a combination tool that includes a pair of retractable jaws capable of being unlocked and moved into an exposed, operating position. The tool includes a single compact unit with, on one end of the handles, pivoted jaws sliding into and out of the handles, and at the distal end of the handles, a selected group of pivotally attached tools.

U.S. Pat. No. 5,142,721, granted Sep. 1, 1992, to G. C. Sessions, et al., teaches of a combination tool that includes a pair of retractable jaws capable of being moved into an exposed, operating position. The tool includes a single compact unit with, on one end of the handles, pivoted jaws sliding into and out of the handles, and at the distal end of the handles, a selected group of pivotally attached tools.

U.S. Pat. No. 5,062,173, granted Nov. 8, 1991, to M. C. Collins, et al., discloses a multifunctional or combinational tool having a screwdriver, a saw blade, a serrated blade, a metal file, and a knife blade, divided into two groups. Each group is color-coded, and rotatably mounted into recesses in a two-part handle, and a pair of pliers, also rotatably mounted in each handle part.

U.S. Pat. No. 4,238,862, granted Dec. 16, 1980, to T. S. Leatherman, discloses a pocket multiple tool having channel shaped handles that are foldable over plier jaws for compact carrying and storage. To maintain a strong grip on an object, a locking means is provided. The handles also contain other useful tools that are foldable about the distal ends of the handles.

The prior art recited above does not teach of the novel advantages that are found in the present invention. Several teach of foldable pliers that are rotatably mounted in the handles for convenient carrying. Others have plier jaws that are pivoted to the elongated handles. None teach of a portable pocket tool having manually extensible pivoted jaws that are self-locking, but also can be positively locked by a rotatable lock means in either its fully elongatable or its fully retractable positions. Additionally, none use powdered metal or metal injection molding technologies to speed production, reduce manufacturing costs and improve product uniformity.

Using Powdered Injection Molding

Injection molding is a productive and widely used technique for shaping plastics. A relatively new technology known as Powder Injection Molding (PIM) uses the shaping advantage of injection molding but is applicable to metals and ceramics. This process combines a small quantity of a polymer with an inorganic powder to form a feedstock that can be molded. After shaping, the polymeric binder is extracted and the powder is sintered, often to near-theoretical densities. Accordingly, PIM delivers structural materials in a shaping technology that was previously restricted to polymers. Manufacturing efficiencies are achieved when the pocket tool is formed using a powdered metal process to minimize shrinkage, the necessity for metal finishing following removal from the mold or part, and to increase speed of production.

In the PIM process, the pocket tool is formed by the steps of creating a multiple cavity mold or part for each component of the assembled tool including the handle subassembly, elongate members of the pliers, pivot pins, fastener or rivet, traveling lock and alternative tools by shaping the part using metallic powders. (Since the tool components are symmetrical, just one cavity for a handle, an elongate member, pin, fastener or rivet and each alternative tool. Distinguishing features, such as the traveling lock hole in one of the elongate members can be attained using a filler material.) Polymeric binders are added to hold the powders in place, while bonding the powders in a sintering furnace to burn off the binder. There is a consequent increase in density of the casted component which then has mechanical, wear and corrosion resistant properties equivalent to a machined material. When the pocket tool is cast in the part by the PIM pressing process, all the required elements thereof can be made by a single injection, which expedites assembly by component production having more precise tolerances with minimal shrinkage or metal finishing.

As a technology, PIM has been around for some time, but really only saw widespread commercialization in the 1980s. For a limited time in the 1920s it was applied to the production of ceramic spark plug bodies. By the late 1950s, many carbide and ceramic components were being shaped using epoxy, wax, or cellulose binders, but the production volumes were small. Major attention was given to the process in 1979 when two design awards were given to metal products.

Metal injection molding or MIM is another manufacturing technique for making complex machined or investment cast parts. MIM merges injection molding and powdered metal technologies by blending a polymer with an extremely fine metal powder. The blended material is injection molded to produce intricately formed parts that are repeatable in high production manufacturing.

In the MIM method, a metal-filled or a metallic powder-filled plastic is injected into a mold and after molding, the plastic is removed with sintering of the molded metal component. Due to the fine powders used, the density of the molded component dramatically increases. After heating, MIM components likewise have mechanical, wear, and corrosion resistance properties equivalent to machined material.

There is a particular need for portable pocket tool that may be carried on a key-chain or be worn around one's neck as a pendant, one that may find application in emergency service conditions, such as in a fishing lure tackle box, an archery repair kit, or a skiing repair kit. Numerous other applications exist.

Accordingly, it is therefore an object of the present invention to provide a novel portable multi-purpose hand-held tool where a handle pair comprises a housing to retain a set of pliers, two types of screwdrivers and ancillary tools selected from a group consisting of an bottle or can opener, corkscrew, knife, and a file.

It is another object of the present invention to provide a novel portable multi-purpose hand-held tool where the housing is a pair of handles from which there are a slidably extensible and slidably retractable set of pliers.

It is still another object of the present invention to provide a novel portable multi-purpose hand-held tool where the housing is a pair of handles having grooved channels that receive the distal ends of the slidably retractable and extensible pliers.

It is still yet another object of the present invention to provide a novel portable multi-purpose hand-held tool where the slidably extensible pliers may be frictionally held in either the retracted or extended positions or positively locked in the retracted or the fully elongated position for use as pliers.

Yet still, another object of the present invention is to provide a novel portable multi-purpose hand-held tool where the slidably retractable pliers may be locked in the fully closed position with each handle closely adjacent to each other for storage in future use.

An additional object of the present invention is to provide a novel portable multi-purpose hand-held tool that that is lower in cost to manufacture, with greater precision, using powdered metal and metal injection molding technologies.

Another objective of the present invention is to provide a self-locking tool that can be secured on a keychain or similarly secured and worn as a pendant on a necklace, thong or the like when not in use.

A final object of the present invention is to provide a novel portable multi-purpose hand-held tool where the handle grips can be maintained in a closed position when the pliers are fully retracted so that the tool housing serves as a leverage handle, thereby making it more convenient when using the ancillary tools such as the screwdrivers.

These as well as other objects and advantages of the present invention will be better understood and appreciated upon reading the following detailed description of the preferred embodiment when taken in conjunction with the accompanying drawings.

SUMMARY OF THE INVENTION

The present invention relates primarily to a novel multi-purpose, pocket tool whose housing principally comprises a pair of handles that house several multifunctional tools. The housing has no sharp edges or protrusions that could cause harm or injury to the one bearing this tool.

Each of the handles contains recessed guides or channel tracks into which the pivoted jaws are frictionally engaged. The pliers are elongatable from the handle pair and may be maintained in the open useful position through a rotatable locking means. The pliers are not only slidably extensible but also slidably retractable, capable of self-locking in retracted or extended positions and, further, of being maintained in one of two positively locked positions, either fully open or fully closed using a traveling lock means.

The tool housing defines a traveling lock opening with a fixed dimension when the handle grips are closed and each handle has a traveling lock channel with a first, a second and a third semicircular receiving port.

The traveling lock means has a traveling mode, a forward lock mode and a rearward lock mode, designated by an actuation button with alternate radially opposite flat surfaces having a narrower width therebetween than the lock opening and engaging radii having a greater width therebetween than the lock opening, a locking cam button and a lock pivot rotatably positioned in a lock pivot hole located in one of the elongate members, whereby the pliers is secured in the extended position during use by a clockwise rotation of the button and mating of the engaging radii with the first receiving port. The pliers can then be retracted into the housing by a counterclockwise rotation of the button that permits slidable motion of the traveling lock means within the lock opening and lock channel.

By use of the traveling lock means, the pliers is also securable in the retracted position presenting the tool housing with a completely smooth surface by another clockwise rotation of the button mating the engaging radii with the second receiving port and, simultaneously, with the third receiving port, whereby the tool is positively locked in the closed arrangement.

There is a lateral recessed cavity in each handle that receives a screwdriver or alternative tool shank that pivots outwardly from the body of the handle. For user convenience, there is a conventional flat bladed screwdriver associated with one of the handles and a Phillips type screwdriver in the opposite handle cavity; and, a variety of alternative tools can likewise be pivotally nested in each handle cavity.

As such, I have invented a self-engaging or self-locking, multi-purpose pocket tool comprising a housing having a pair of handles each having an internal channel track with a pliers slidably mounted in the channel track for transfer between a retracted position within the housing and an extended position projecting outside of the housing. The pliers including a pair of pivotally connected elongate members that have opposed jaws at one end and a projecting pad at or near the distal end. Meanwhile, each handle incorporates a longitudinal channel to receive a pad as the internal tracks engage the jaws. The pliers is manually extensible from and retractable into the housing and using a slide means of an elongate member, whereby the pliers is retained in the retracted position by a frictional engagement of the jaws with the tracks.

In a fully closed condition with the pliers retracted, the housing has a completely smooth surface with no sharp edges or protrusions that could cause harm or injury to the one bearing the tool, which is thus self-locked because the opposed jaws block opening of the tool.

The traveling lock means on an elongate member is included for positively locking the pliers in the extended and retracted positions for safely securing the tool on a key ring, key chain, necklace, thong, or the like.

BRIEF DESCRIPTION OF THE DRAWINGS

The present invention is pictorially illustrated in the accompanying drawings that are attached herein.

DETAILED DESCRIPTION OF THE INVENTION

The present invention provides a multi-function pocket tool having slidably extensible pliers that can be locked in operating position when in use and, slidably retracted within the handles for convenient storage when not in use. When retracted, a frictional locking cam, when used, maintains the stored position. Further, when retracted, the tool is self-locking since the jaws are obstructed from pivotally rotating, thereby maintaining the handles in close proximity to each other and keeping the tool from opening.

There are two cutting surfaces provided between the jaws of the pliers; one notched cutting surface for cutting wire and one shearing surface for wire stripping and the like. Two foldable pivoted screwdrivers comprising a flattened blade type and a Phillips end type are included to provide versatile portable tool operation.

Figure 1:
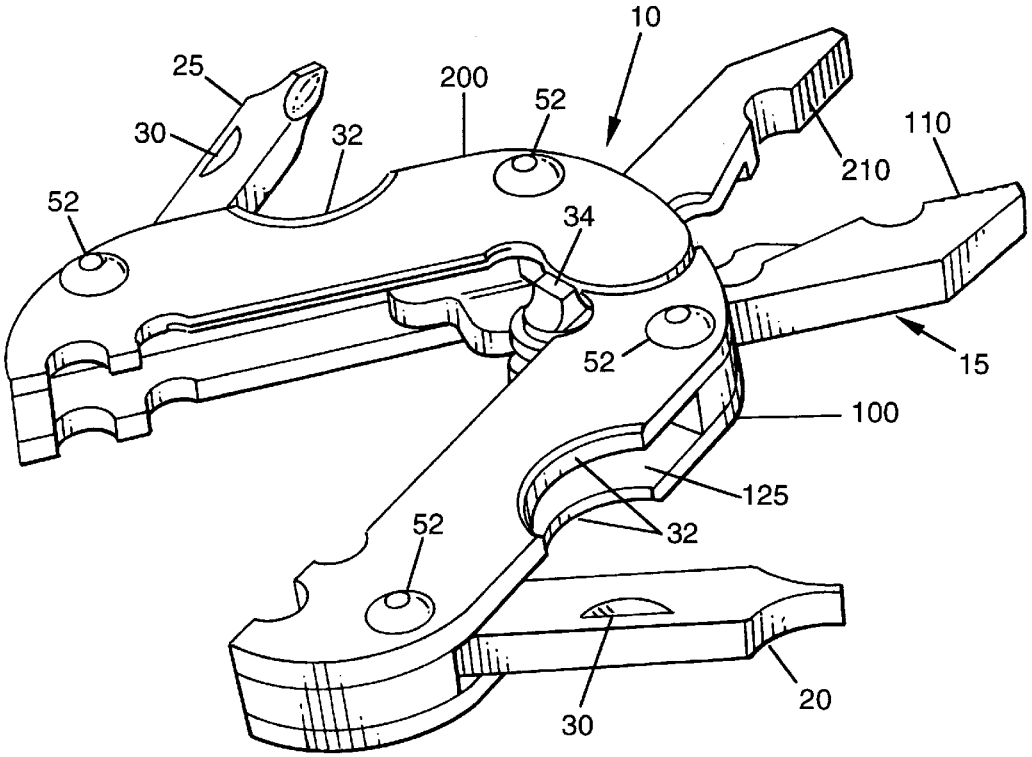
FIG. 1 is an axonometric projection of the multifunctional pocket tool shown with the screwdrivers in their partially extended positions and with the pliers extended and the jaws open.

Referring to FIG. 1, the pocket tool 10 is comprised of a right handle 100 and a left handle 200 which house the retractable pliers 15.

The multi-functional tool, embodying the principles of the present invention, is illustrated in an axonometric projection, showing the assortment of tools; the pliers 15 in their fully extensible exposed position with the jaws 110 and 210 fully open and the handle grips 100 and 200 separated, the ancillary screwdrivers 20 and 25 are open and exposed from their nested cavities 125,225.

Figure 6:
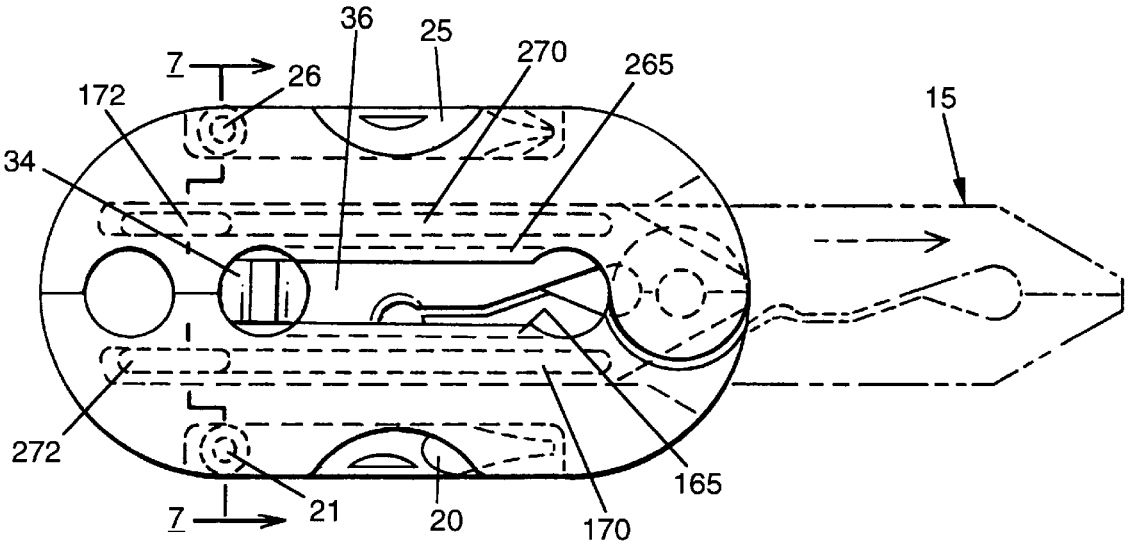
FIG. 6 is a plan view of the pocket tool illustrating in phantom lines the pliers retracted in the handle housing, and in solid lines, the pair of blunt-nosed pliers in their extended position.

The left handle 200 houses the pivoted noncollinear bladed screwdriver 25 into a receiving storage compartment 225, (FIG. 6); and in like manner, the right handle 100 houses the flat bladed screwdriver 20 into its respective storage compartment 125. As best shown in FIG. 6, the Phillips type screwdriver 25 pivots about second pivot pin 26 and the flat bladed screwdriver 20 about the first pivot pin 21. As further shown in FIG. 7, two concave spring washers 54 provide the necessary friction to maintain the relative positions of the screwdrivers 20 and 25.

Each pocket tool is provided with a fingernail grip 30 to aid in opening the tool out of its handle. In each handle there is a cutaway finger notch 32 to provide accessibility to the fingernail grip 30 on each respective tool. Two finger notches 32, symmetrically located in each half handle, one on the top surface and one on the bottom surface, are provided to allow a larger gripping area on the tool when opening it. The notches are well rounded and contoured to eliminate any sharp edges that could lacerate one's finger.

Figure 2:
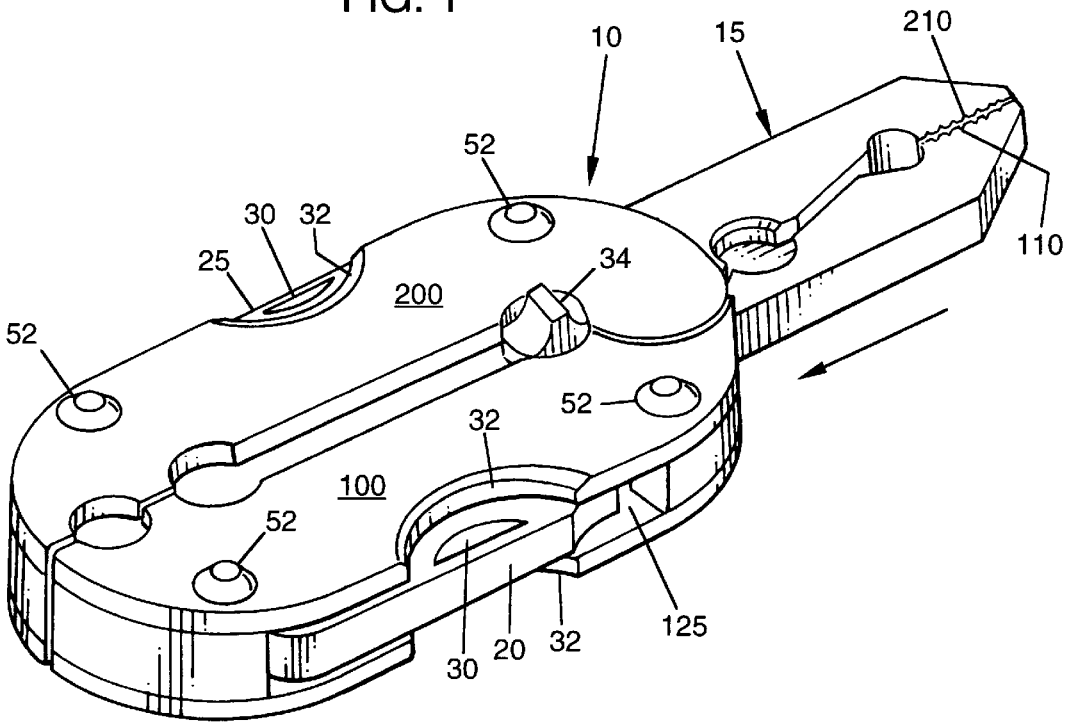
FIG. 2 is an axonometric projection of the multifunctional pocket tool with the screwdrivers in their nested positions and with the pliers extended and the jaws closed.

As shown in FIG. 2, the pliers 15 are in their fully extensible exposed position with the jaws 110 and 210 fully closed and the handle grips 100 and 200 also fully closed. Both of the ancillary screwdrivers 20 and 25 are closed and nested securely into their respective storage cavities 125 and 225. The traveling locking means 34 includes the slidable lever, slide or button 44, (FIG. 5A), that is used to retract the pliers 15 within the pocket tool handle housing, formed by the closure of right handle 100 and left handle 200. Before the pliers can be retracted, the locking device 34 must be rotated one-quarter turn counterclockwise to release the frictionally held cam 46.

Figure 3:
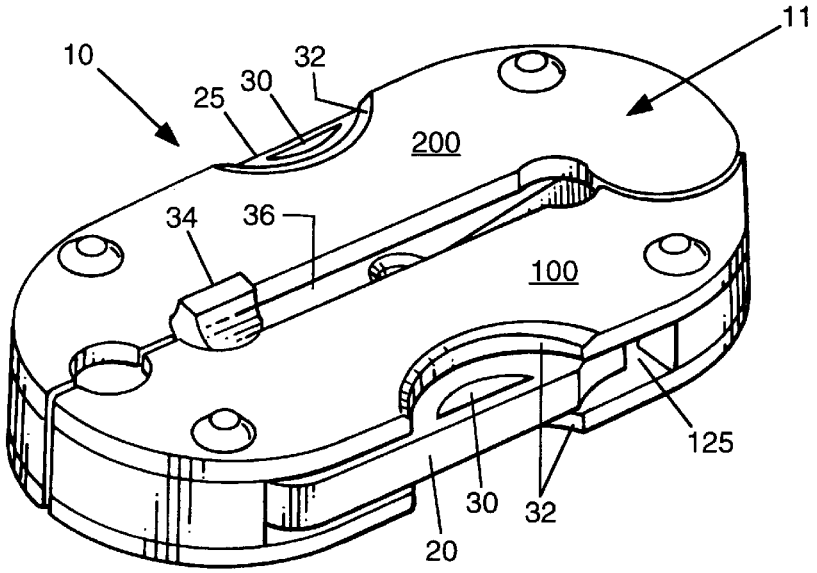
FIG. 3 is an axonometric projection of the multifunctional pocket tool with the screwdrivers in their nested positions and with the jaws closed and the pliers fully retracted.

FIG. 3 illustrates the pliers in their fully retracted concealed position with its jaws fully closed and the handle grips 100 and 200 also fully closed. Both of the ancillary screwdrivers 20 and 25 are closed and nested securely into their respective storage cavities 125 and 225. The traveling locking means 34, with a slidable lever that is used to retract the pliers within the pocket tool handle housing, formed by the closure of right handle 100 and left handle 200, is now in the storage and carrying position. To secure the pliers in their storage position, the locking device 34 must be rotated one-quarter turn clockwise to lock the frictionally held cam. When the pliers is retracted and the alternative tools, the screwdrivers, are nested in their storage compartments, the housing 11 presents a complete smooth surface.

Figure 4:
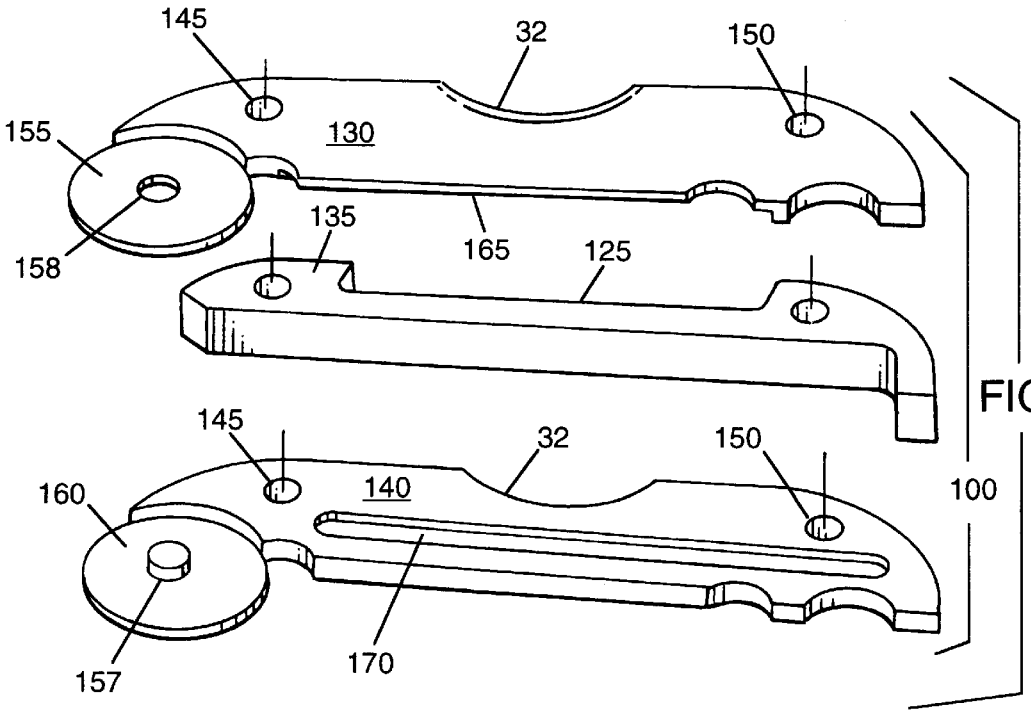
FIG. 4 is an exploded perspective view of the right-hand handle grip of the multifunctional pocket tool illustrating the three major components of the sub-assembly.

Turning now to FIG. 4, there is shown an exploded view of the right handle subassembly. The right handle subassembly is comprised of the inner layer 135, positioned between the upper surface plate 130 and the lower surface plate 140.

An upper and lower pivoting area is depicted as 155 and 160 respectively. These pivoting areas are interleaved with upper and lower pivoting areas found in the left handle and connected by mating pivot post 157 inserted into a hole 158 in the corresponding lower plate, of the left handle subassembly, (not shown). The thickness of each of the pivoting areas is preferably one half the thickness of either the upper surface plate 130 or the lower surface plate 140, both having equal thickness.

The locking channel 165 is a longitudinal slot or groove located on the under side of the upper surface plate 130 that slidably captures locking cam 46 and running parallel to the slidable lock opening 36.

Figure 5:
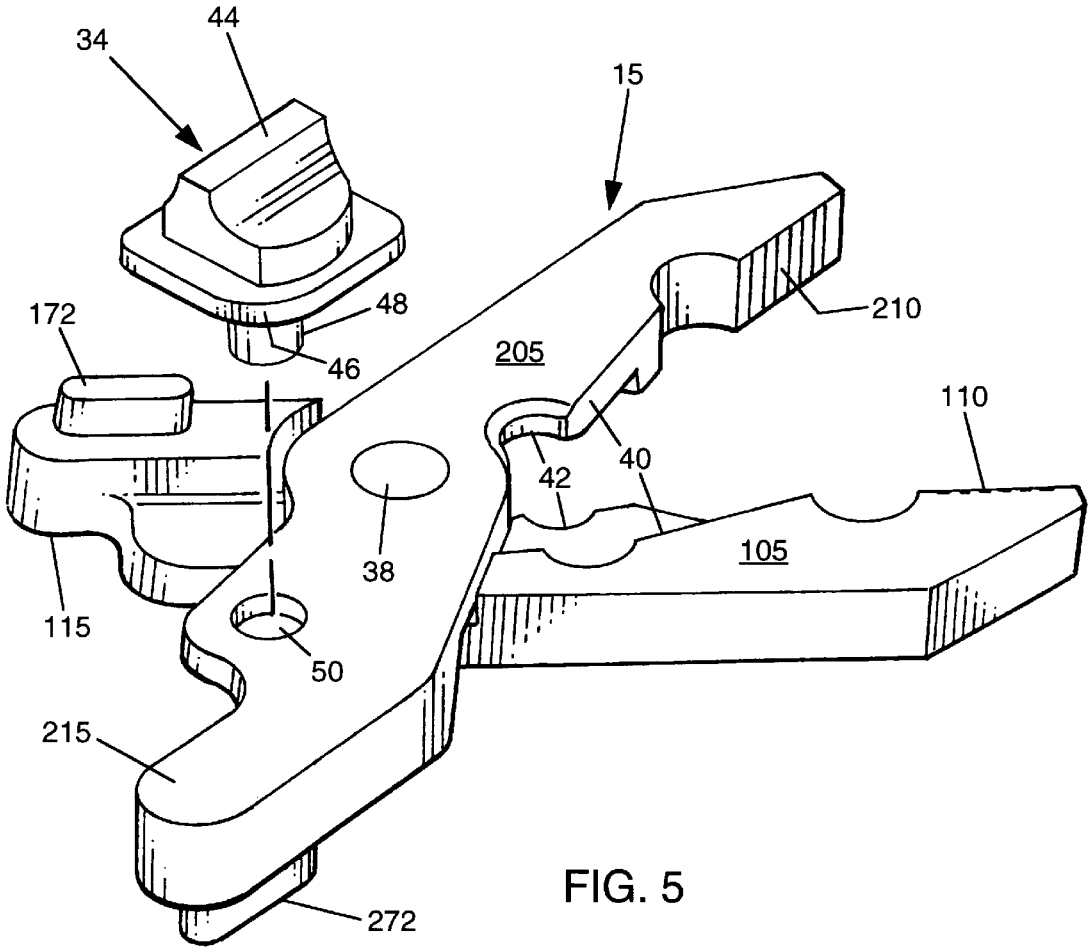
FIG. 5 is an axonometric projection of the pliers removed from the handle housing showing the rotary locking cam.

The rectangular grooved channel 170 is designed to receive the right side rectangular pad 272 (shown in FIG. 5). The depth of the grooved channel is preferably one half the thickness of the lower surface plate 140.

The entire assembly is held together with fasteners or rivets 52, (FIGS. 1 and 7), one passing through the forward holes 145 and the second passing through the rearward holes 150.

Because of the symmetry between the left and right hand handles, where the left hand handle replicates the right hand handle inverted about its major axis by 180 degrees, only the right hand handle is shown in detail as being typical. The tool can be made with only seven components: the handle plate and inner layer, the elongate member, pivot pin, traveling lock and two screwdrivers. As disclosed herein, I have found maximum efficiency in making these components in a multi-cavity part constructed with PIM and MIM technologies. (Exceptions: 1.) The concave spring washers are produced on a separate run; and 2.) The lock hole in the elongate member bearing the traveling lock and other minute differences in the components are replicated using fillers in the casting part.)

FIG. 5 details the jaw assembly of the pliers 15 together with the traveling, rotatable lock means 34. The pliers 15 are adapted to be fully extended when in the operational position and fully retracted into the handles 100 and 200 when not in use. In their fully extended position, the plier jaws 110 and 210 pivot radially in response to the opening and closing of the handles 100 and 200. The plier jaws are comprised of a first elongated member or tine 105 and a second elongated member or tine 205. The elongated members 105 and 205 are arranged to move pivotally about the pivot pin 38.

The plier jaws 110 and 210 are preferably blunt nosed and are intended primarily for gripping thin flat objects. Each jaw has serrated gripping portions, on an inner opposing surface thereof, to allow for a more positive gripping action. The pliers are also equipped with a scissors shear 40 and a wire cutting or stripping notch 42.

Figure 5A:
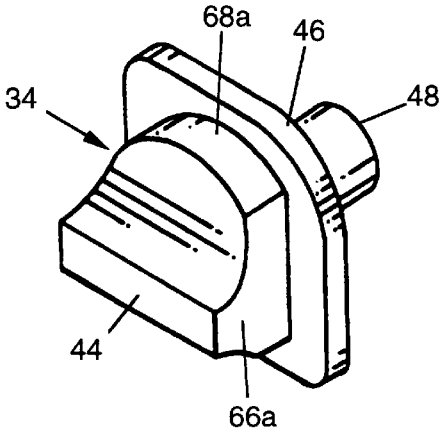
FIG. 5A is a perspective view of the rotary locking cam.
Figure 5B:
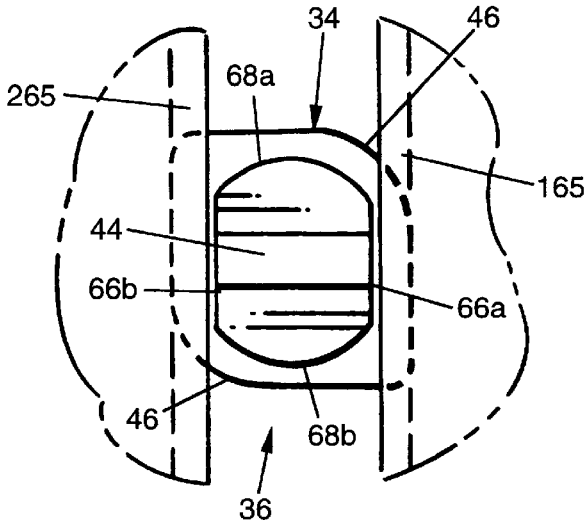
FIG. 5B is a top plan of the rotary locking cam.
Figure 9:
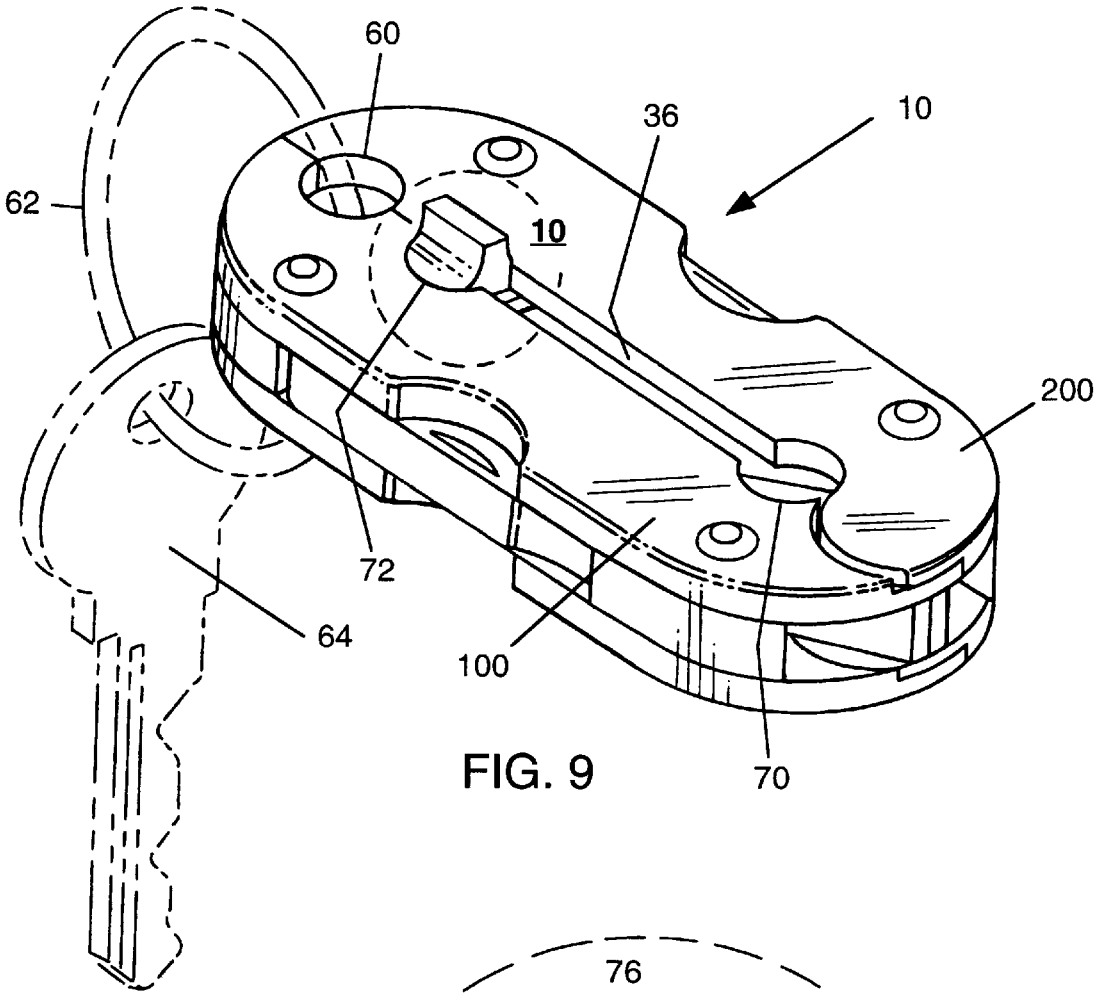
FIG. 9 is an axonometric projection of the multifunctional pocket tool with the screwdrivers in their nested positions and with the jaws closed and the pliers fully retracted.

In FIGS. 5A and 5B, there is shown in detail, the traveling locking means 34. The traveling locking means 34 comprises the actuating button or slide 44, traveling flat surfaces 66*a* and 66*b,* engaging radii 68*a* and 68*b,* locking cam 46 and lock pivot 48. The lock pivot 48 inserts into the lock pivot hole 50 located in elongate member 205. The traveling lock assembly 34, traveling flat surfaces 66*a* and 66*b,* the engaging radii 68*a* and 68*b,* and actuating button 44 slidably travel in the slidable lock opening 36 (FIGS. 3 and 9).

The slidable lock opening 36 has a fixed dimensional opening when handles 100 and 200 are in the closed position. When actuating button 44 is rotated to its furthest counter-clockwise position, the traveling lock means 34 is in its unlocked mode and will permit slidable motion of the traveling lock means 34. This resulting rotation positions the traveling flat surfaces 66*a* and 66*b* to be parallel with slidable lock opening 36, thereby permitting slidable travel to the extreme ends, because the total dimension between the traveling flat surfaces 66*a* and 66*b* is slightly less than that of the slidable lock opening 36.

The slidable lock opening 36 also prevents the rotation of actuating button 44 throughout its travel because the total dimension between the engaging radii 68*a* and 68*b* is greater than that of slidable lock opening 36; the exception being when the traveling locking means 34 is at its extreme end of travel, with the pliers 15 being in either the fully extended or fully retracted position.

When the pliers 15 are in the fully extended and opened position, the traveling locking means 34 is in the first position where the lock engagement is permitted. Rotating the actuating button 44 ninety degrees clockwise frictionally engages the locking cam 46 with the locking channel 165, thereby preventing further slidable motion. The rotation of actuating button 44 also causes engaging radius 68*a* to mate with the first semicircular receiving port 70 of handle or handle grip 100. The total dimension of engaging radii 68*a* and 68*b* is greater than that of the slidable lock opening 36 which does not permit any further travel of the traveling lock means 34, therefore locking the pliers in their extended position during use.

When the pliers 15 are in the fully retracted and closed position, the traveling locking means 34 is in the second position where lock engagement is permitted. Rotating the actuating button 44 ninety degrees clockwise frictionally engages the locking cam 46 with the locking channel 265, in addition to engaging with the locking channel 165.

Figure 5C:
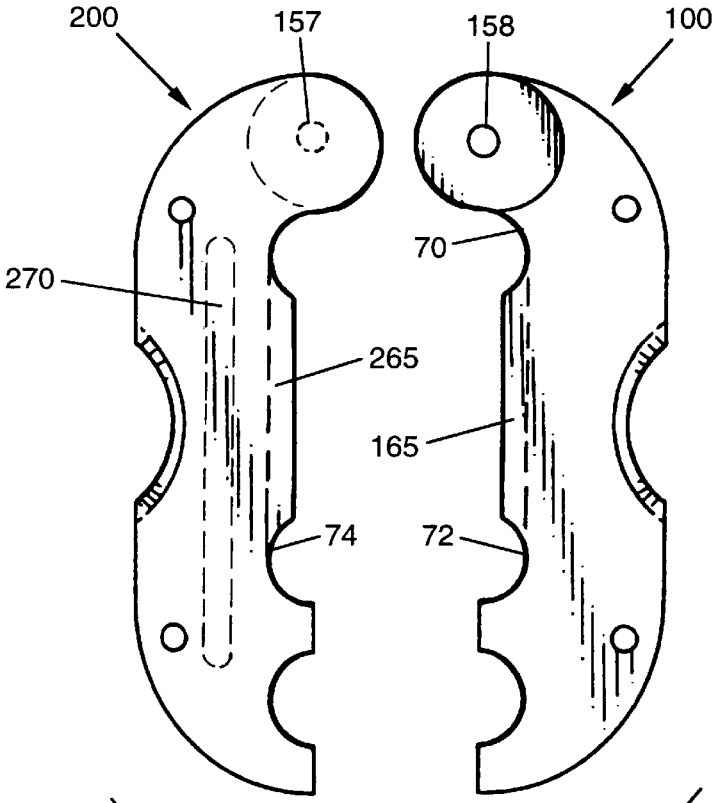
FIG. 5C is an exploded top plan showing the right-hand and left-hand handle grips.

With reference now to FIG. 5C, it also causes the engaging radius 68*a* to mate with the second semicircular receiving port 72 of handle or grip 100. In addition, it also causes the engaging radius 68*b* to mate with the third semicircular receiving port 74 of elongated member 200. The total dimension of the engaging radii, 68*a* and 68*b,* is greater than that of the slidable lock opening 36 and does not permit the pliers is from sliding from their fully retracted position when the actuating button 44 is in its full clockwise position, therefore creating a locking system to store the tool on ones key-ring, a key chain in ones pocket or as a pendant on a necklace, thong or the like, around ones neck, when not in use.

Figure 7:
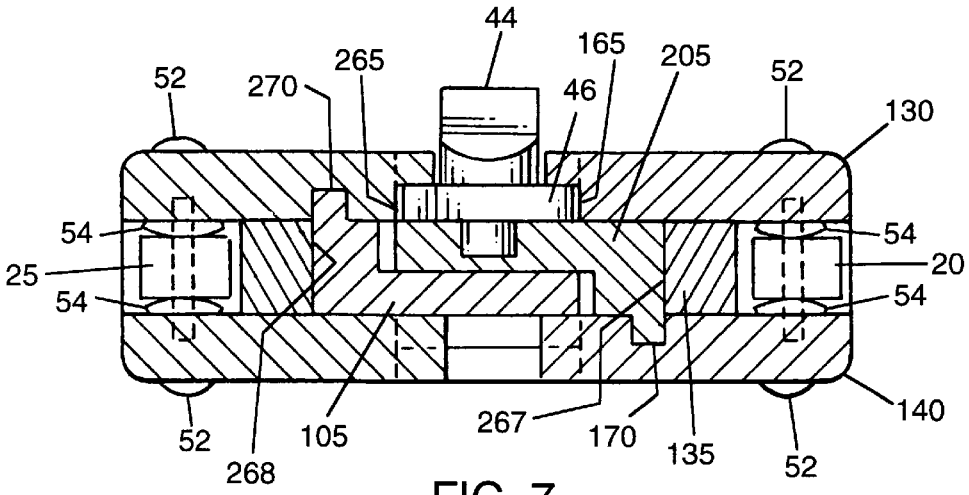
FIG. 7 is a side sectional view of the multifunctional pocket tool taken along the section 7—7 as shown in FIG. 6.
Figure 8:
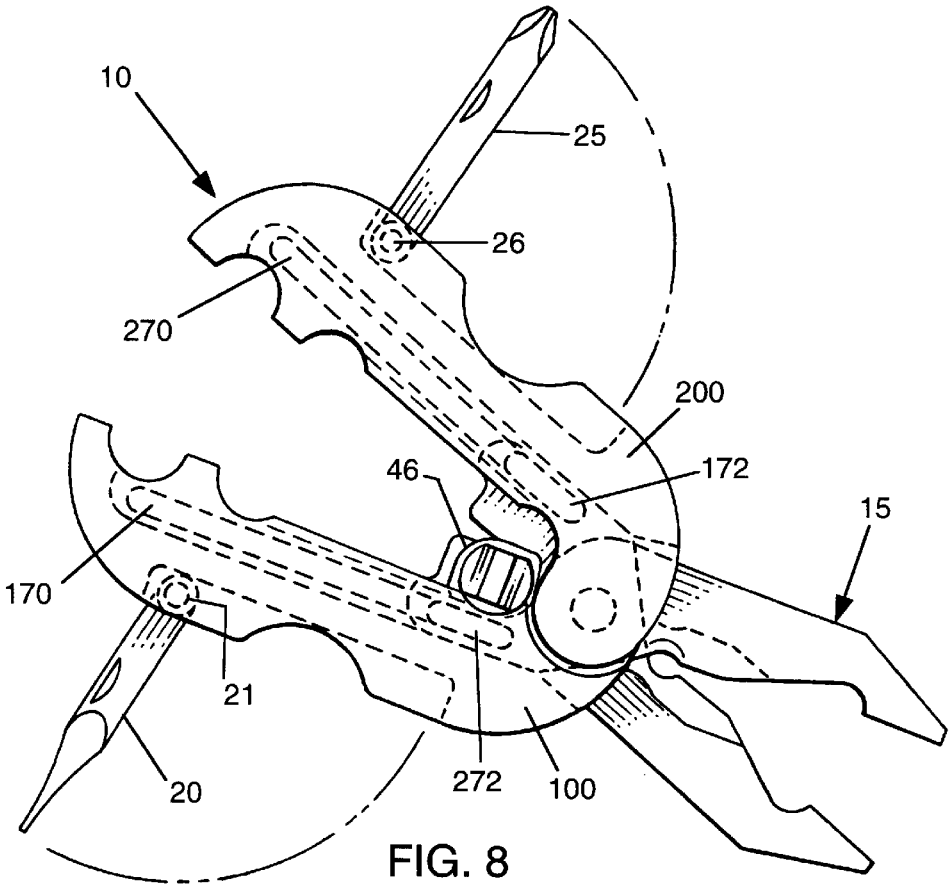
FIG. 8 is a top elevational view of the multifunctional pocket tool showing the pliers fully extended with the jaws open and the screwdrivers in their open unfolded positions.

FIGS. 6, 7 and 8, in conjunction with FIG. 5, further detail the design and operation of the pocket tool with its traveling rotatable locking means. The pads 172 and 272 are rectangularly shaped having rounded semicircular ends. These pads are slidably engaged in the rectangular grooved channels 170 and 270, where pad 172 is slidably engaged in rectangular channel 270 and pad 272 is slidably engaged in rectangular channel 170.

Rotating the actuating button 44 ninety degrees rotates the locking cam 46 so that it frictionally engages the locking channel 165 when the pliers are fully extended. When the pliers are fully retracted, the locking cam 46 frictionally engages with the locking channel 265, in addition to engaging with the locking channel or track 165.

The pliers 15 can automatically lock in retracted position within the housing. As such, lever or button 44 may serve as a manual slide, whereby the pliers is manually extensible from and retractable into the housing with the pliers retained in said retracted position by a frictional engagement of the jaws 110,210 with the guides or channel tracks 267,268. The housing in a fully closed condition, (FIG. 3), with the pliers in the retracted position, provides a housing surface that is completely smooth with no sharp edges or protrusions that could cause harm or injury to the one bearing the tool; and, the tool is self-engaging and locked in said fully closed condition with the opposed jaws 110,210 blocking unintended opening of the tool.

Figure 8A:
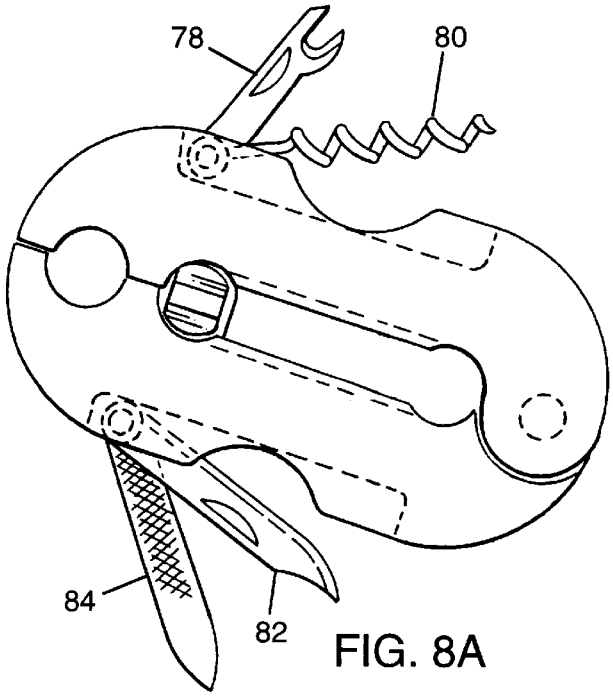
FIG. 8A is a top elevation showing alternative tools unfolded from respective storage compartments including an opener, corkscrew, knife and a file.

Referring now to FIG. 8A, the pocket tool preferably includes alternative tools in addition to variously sized flat bladed and Phillips screwdrivers; such alternative tools selected from a group consisting of a can or bottle opener 78, a corkscrew 80, a knife 82, and a file 84.

The pocket tool is shown in FIG. 9 in its closed carrying position where it can be carried on a key ring holder. The key ring 62 can be inserted into circular aperture 60 when the jaws are open with the handles separated. The key ring 62 in turn supports the key(s) 64. Alternatively, the pocket tool may be worn around one's neck as a pendant using a leather thong, a necklace or chain. Since this popular use involves more stress on the tool, such as the common practice of flipping the key ring around a finger against the hand or another surface, slide 44 is preferably a traveling lock means as opposed to reliance on frictional engagement of the pliers within the handle members, whereby the pliers 15 can be positively locked in the retracted position to ensure closure of the tool 10, thereby securing it on the key ring 62.

The pocket tool 10 disclosed herein is ideally suited to be manufactured using powdered metal or metal injection molding technology. The use of powdered metals provides improved uniformity, quality and production yield of the components being produced. A multiple cavity mold can be created that is capable of producing virtually all of the necessary components disclosed using only one injection. Polymeric binders are used in shaping these small powders, holding them in place until bonding in a sintering furnace. The use of powdered metal technology can potentially reduce the manufacturing and assembly costs.

Figure 10:
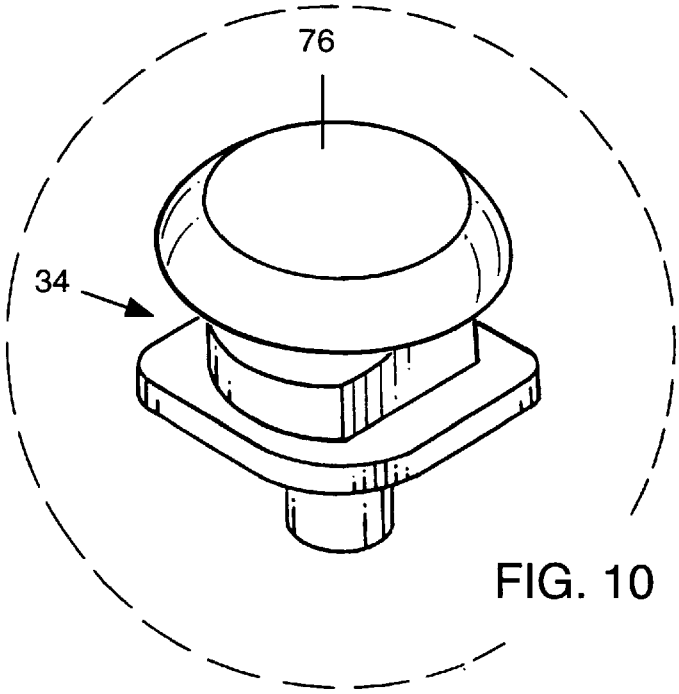
FIG. 10 is a perspective view of an alternative embodiment of the traveling lock having a mushroom shaped cam operator.

As shown in FIG. 10, there is a perspective view of an alternative embodiment of the traveling lock 34 having a mushroom shaped slide operator 76. The mushroom shaped operator allows for a more intimate contact with ones thumb when rotating the locking mechanism and when slidably moving the pliers to either their fully open or fully closed position. A small colored depression on the mushroom shaped operator gives the indication of being in the locked or open position.

It should be understood that there may be numerous modifications, advances or changes that can be made to the present invention, but in doing so, it is intended that they should not detract from the true spirit of the present invention.

I claim:

1. A self-engaging, multi-purpose pocket tool comprising a housing including a pair of handles each having an internal track; a pliers slidably mounted in the track for transfer between a retracted position within the housing and an extended position outside the housing, including a pair of pivotally connected elongate members, each having an opposed jaw at a first end and a projecting pad near a second end; each handle having a longitudinal channel to receive a pad; and, one of said elongate members having a slide means, whereby the pliers is manually extensible from and retractable into the housing and retained in said retracted position by a frictional engagement of the jaws with the tracks; each handle comprising a subassembly with an inner layer positioned between an upper surface plate and a lower surface plate; each plate having forward and rearward ends with a pivot area on the forward end interleaved with plates of an opposed handle; and, each subassembly having forward and rearward collinear holes with a fastener therein to hold the subassembly together.

2. The self-engaging, multi-purpose pocket tool according to claim 1, the housing having a fully closed condition with the pliers in the retracted position and a completely smooth housing surface with no sharp edges or protrusions that could cause harm or injury to the one bearing the tool in said fully closed condition wherein the tool is locked by the opposed jaws that block an unintentional opening of the tool.

3. The self-engaging multi-purpose pocket tool according to claim 1, further comprising a traveling lock means positioned on an elongate member of the pair for positively locking the pliers in the extended and retracted positions.

4. The self-engaging multi-purpose pocket tool according to claim 3, wherein the pair of elongate members are connected by a pivot pin.

5. The self-engaging multi-purpose pocket tool according to claim 4, each handle comprising an extension of a corresponding elongate member of the pliers in the extended position for use of the pliers by manually moving the handles to an open position and a closed position about said pivot pin for operating the pliers from an open to a closed position.

6. The self-engaging multi-purpose pocket tool according to claim 5, the tool having an aperture therethrough for mounting the tool on a keychain or the like and carried on the keychain or worn as a pendant.

7. The self-engaging multi-purpose pocket tool according to claim 6, said aperture defined by said handles of the housing, for temporarily securing the tool on a key ring, keychain, necklace, thong or the like.

8. The self-engaging multi-purpose pocket tool according to claim 6, said aperture defined by one or both of said jaws of the pliars, for temporarily securing the tool on a keychain, a suspending device or the like.

9. The self-engaging multi-purpose, pocket tool according to claim 6, each said handle including a lateral side storage compartment for an at least one ancillary tool pivotally mounted in each compartment on a pin including a pair of spring washers to frictionally retain the at least one tool nested within a respective compartment or in an open condition.

10. The self-engaging multi-purpose pocket tool according to claim 9, wherein the housing in the closed condition comprises a leverage handle for operation of the at least one ancillary tool in the open condition.

11. The self-engaging multi-purpose pocket tool according to claim 10, each handle further comprising an at least one cutaway finger notch for accessibility to each tool.

12. The self-engaging multi-purpose pocket tool according to claim 11, each jaw including a serrated gripping portion on an inner opposing surface thereof, for an enhanced positive gripping action.

13. The self-engaging multi-purpose pocket tool according to claim 12, each elongate member of the pliers including a scissors shear for cutting paper or the like.

14. The self-engaging multi-purpose pocket tool according to claim 13, the pliers further including a wire cutting notch for stripping or cutting wire or the like.

15. The self-engaging multi-purpose pocket tool according to claim 14, wherein each handle subassembly of the handle pair is symmetrical.

16. The self-engaging multi-purpose pocket tool according to claim 15, the at least one ancillary tool selected from a group consisting of a flat blade screwdriver, a Phillips screwdriver, an opener, a corkscrew, a knife, and a file.

17. The self-engaging multi-purpose pocket tool according to claim 16, wherein the pocket tool is formed using powder injection molding by a process comprising the steps of creating a multi-cavity mold by shaping the mold to define the handle inner layer, surface plate, elongate member, pivot pin, traveling lock, the flat blade and the Phillips screwdrivers using metallic powders; adding polymeric binders to hold the powders in place; bonding the powders in a sintering furnace and burning off the binder; casting the tool by a single injection, compressing the mold to minimize shrinkage and metal finishing and to increase speed of production; and, assembling the tool.

18. The self-engaging multi-purpose pocket tool according to claim 16, wherein the pocket tool is formed using a metal injection molding process comprising the steps of injecting a metal-filled plastic into a multi-cavity mold defining the handle inner layer, surface plate, elongate member, pivot pin, traveling lock, the flat blade Phillips screwdrivers, sintering to dramatically increase a density and remove the plastic to minimize shrinkage and metal finishing, and increase speed of production.

19. A multi-purpose, pocket tool comprising:

a pair of interlocked handle grips having an open arrangement and a closed arrangement comprising a smooth housing;

a pliers with a pair of elongate members rotatably mounted on a pivot pin, each member having first and second ends with a pivot jaw at the first end; each handle having a channel to slidably retain an elongate member second end, wherein the pliers is slidably extensible from a retracted position within the housing to an extended position;

said tool housing defining a traveling lock opening when the housing is closed, said opening having a fixed dimension when the handle grips are closed that receives an actuation button to manually extend the pliers from the housing with an associated traveling lock means mounted on the pliers for securing the pliers in the extended or retracted positions and to alternately lock the tool in its open or closed arrangement.

20. The multi-purpose, pocket tool according to claim 19, the housing defining a traveling lock opening with a fixed dimension when the handle grips are closed and each handle including a traveling lock channel and a first, a second and a third semicircular receiving port;

the traveling lock means, having a traveling mode, a forward lock mode and a rearward lock mode, comprises the actuation button with alternate radially opposite flat surfaces having a narrower width therebetween than the lock opening and engaging radii having a greater width therebetween than the lock opening, a locking cam button and a lock pivot rotatably positioned in a lock pivot hole located in one of the elongate members, whereby the pliers is secured in the extended position during use by a clockwise rotation of the button and mating of the engaging radii with the first receiving port; the pliers can be retracted into the housing by a counterclockwise rotation of the button that permits slidable motion of the traveling lock means within the lock opening and lock channel; wherein the pliers is securable in the retracted position presenting the tool housing with a completely smooth surface by another clockwise rotation of the button mating the engaging radii with the second receiving port and, simultaneously, with the third receiving port, whereby the tool is locked in the closed arrangement.

21. A multi-purpose, pocket tool comprising a pair of handles defining a housing secured by a plurality of fasteners, a pliers with opposed jaws and a pair of pivotally connected tines each slidably mounted in the housing responsive to a manipulation of the handles, a slide associated with the pliers to push the pliers to an extended position and pull the pliers back to a retracted position within the housing, the pocket tool formed by a process comprising the steps of creating a multiple cavity part by shaping the part to define a handle, a tine, a fastener and a slide; blending a polymeric binder with a metallic powder to form a metallic powder-filled plastic; injecting the metallic powder-filled plastic into the part; bonding the metallic powder in a sintering furnace for burning off the binder and removing the plastic, for casting the pocket tool by a single injection for an increase in a density of the tool having mechanical, wear and corrosion resistant properties equivalent machined material; and, assembling the tool.

22. The multi-purpose, pocket tool according to claim 21, wherein the tool includes a traveling lock means positioned on the pliers for positively locking the pliers in the extended and retracted positions.

23. The multi-purpose, pocket tool according to claim 22, wherein the traveling lock means includes a mushroom shaped slide operator.

* * * * *